US006010203A

United States Patent [19]

Muraki

[11] Patent Number: 6,010,203

[45] Date of Patent: Jan. 4, 2000

[54] APPARATUS FOR RECOVERING AN INK JET HEAD AND INK JET RECORDER INCLUDING THE SAME

[75] Inventor: Motohito Muraki, Nagoya, Japan

[73] Assignee: Brother Kogyo Kabushiki Kaisha, Nagoya, Japan

[21] Appl. No.: 08/889,552

[22] Filed: Jul. 8, 1997

[30] Foreign Application Priority Data

Jul. 9, 1996 [JP] Japan ..... 8-179062
Aug. 19, 1996 [JP] Japan ..... 8-217179

[51] Int. Cl.[7] ..... B41J 2/165

[52] U.S. Cl. ..... 347/30; 347/29; 347/32

[58] Field of Search ..... 347/29, 30, 31, 347/32

[56] References Cited

U.S. PATENT DOCUMENTS 5,055,856 10/1991 Tomii et al. ..... 347/29
5,252,993 10/1993 Tomii et al. ..... 347/29
5,426,456 6/1995 Kuelzer et al. ..... 347/30

FOREIGN PATENT DOCUMENTS 3-93548 4/1991 Japan .
7-68766 3/1995 Japan .
7-68788 3/1995 Japan .
2269344 2/1994 United Kingdom .

*Primary Examiner*—N. Le
*Assistant Examiner*—Shih-Wen Hsieh
*Attorney, Agent, or Firm*—Oliff & Berridge, PLC

[57] ABSTRACT

An ink jet recorder includes an ink jet head, a cap for covering the head, and a suction pump for sucking through the suction port of the cap the ink remaining between the head and cap. The cap surface can turn on an axis between a position in parallel with the jet surface of the head and a position inclined with respect to the jet surface. The cap is biased to incline at least before the cap surface contacts with the jet surface. The turning axis is positioned between a first reference plane and a second reference plane. The first plane includes the cap surface at the parallel position. The second plane is parallel with the first plane, and includes the point on the cap surface which contacts first with the jet surface. The vertical position of the cap surface does not shift between the start and end of the contact. The cap suction port is positioned below the jet ports in the jet surface.

38 Claims, 9 Drawing Sheets

APPARATUS FOR RECOVERING AN INK JET HEAD AND INK JET RECORDER INCLUDING THE SAME

BACKGROUND OF THE INVENTION

1. Field of the Invention

The present invention relates to a capping apparatus and a recovering apparatus for an ink jet head, and an ink jet printer having the ink jet head.

2. Description of the Related Art

Conventional recovery apparatus for the ink jet head of the ink jet printer includes an apparatus for protecting the jet nozzle of an ink jet head and/or preventing the nozzle from drying. This apparatus includes a cap for covering the jet surface in such a manner that the cap can open and close the surface. Another conventional recovery apparatus is a suction apparatus for sucking and discarding the thickened ink in an ink jet head so as to prevent the jet nozzle from being clogged or remove clogging ink, if any, and/or for introducing ink into the head when the ink cartridge is replaced. The suction apparatus includes the cap and a pump connected to the suction cavity or recess of the cap.

The front surface of the cap of such a recovery apparatus is brought into close contact with the jet surface and separated from it in a state that both the surfaces are in parallel each other. Therefore, when the surfaces contact closely together, the air in the cap cavity is pressurized, pushing back the meniscus in the nozzle, so that air may be entrained. When the surfaces separate from each other, particularly in the case of a suction apparatus, air is entrained due to the residual negative pressure because the whole cap surface is separated at a time from the jet surface. This may cause splash or scatter of ink, and may also entrain air bubbles into the nozzle, preventing ink from being jetted.

FIG. 5 shows a conventional recovery apparatus including a cap 30 fixed to a support 34, which is biased by a spring 31 so as to normally incline the cap 30. The inclined cap 30 can be gradually brought into close contact with the jet surface 32, and gradually separated from it. Apparatus of this type are disclosed in, for example, Japanese Patent Applications Laid-Open No. 3-93548, No. 7-68788, and No. 7-68766 corresponding to GB 2,269,344.

The cap 30 of the apparatus shown in FIG. 5 can turn around a horizontal pin 33, which is positioned at the support 34 opposite the front surface 30*a* of the cap. Consequently, when the cap 30 turns after the lower portion of the cap brim 30*b* contacts with the jet surface 32, this lower portion shifts or slips down from the position where it first contacts. It is therefore necessary to make the jet surface 32 large enough for accommodation to the slip of the cap 30. This may increase the size and/or costs of the apparatus. In addition, the foregoing cap motion occurs frequently, and the cap 30 slips each time the motion occurs. As a result, the cap brim 30*b* may deform, decreasing the closeness of contact of the cap 30.

The recovery apparatus shown in FIG. 5 is fitted to the ink jet printer separately from the ink jet head. As a result, the cap surface has a slight inclination relative to the jet surface due to inaccuracy of parts, fitting inaccuracy, and the like. Therefore, in order to securely prevent air from being entrained as stated above, it is necessary for the cap to have a large inclination to some extent. If the cap has a large inclination, however, the lower contact portion of the cap brim slips more. This may make the foregoing problem more serious.

The conventional recovery apparatus has another problem as stated below.

Before the ink jet printer starts printing, the recovery apparatus purges the inside of the nozzle through its purge chamber by means of a pump. Then, while the cap is released with, for example, its top being opened, the pump sucks further to purge away the ink which has been sucked from the nozzle toward the purge chamber and has adhered to the jet surface. As a result, it is possible to prevent the nozzle from being clogged with ink or remove clogging ink. It is therefore possible to suck and discard the thickened ink, and/or introduce ink into the ink jet head when the ink cartridge is replaced. If the cap was separated from the nozzle with the cap surface in parallel to the jet surface, excessive negative pressure would develop in the purge chamber. The entrainment of air due to the negative pressure would splash or scatter ink, and/or mix air bubbles with the ink in the nozzle. Therefore, when the cap is released, the cap is inclined in such a manner that it is opened from above. Such technique is disclosed in Japanese Patent Application Laid-Open No. 3-93548 etc.

When air is sucked while the cap of the conventional recovery apparatus is released, at least the lowest jet ports in the jet surface contact with the ink remaining in the purge chamber until the air suction ends. As a result, until the air suction ends, ink is entrained and flows back together with air bubbles into the nozzle, through the jet ports in contact with the ink, due to the ink turbulence and/or air turbulence occurring when the cap is released.

In greater detail, as shown in FIG. 9, the cap 214 has a suction port 214*b* formed through it above the lowest jet ports 211*a* of the jet head 211. Specifically, as shown in the upper half of FIG. 9, the distance "a" between the top of the suction port 214*b* and the bottom of the cap brim 214*a* is longer than the distance "b" between the bottom of each lowest jet port 211*a* and the bottom of the brim 214*a* (a>b). As a result, until the air suction with the cap 214 and jet head 211 ends, ink 100 is entrained and flows back with air bubbles into jet ports 211*a* due to the ink turbulence and/or air turbulence occurring when the cap 214 is released.

The ink which has flowed back and contains air bubbles and/or the like may cause defective jet when printing starts. As a result, the recovery by suction is less effective, so that the print may be defective. It is therefore not possible to meet general demands for recent high-quality printing in the technical field of ink jet heads.

SUMMARY OF THE INVENTION

It is therefore an object of the present invention to provide a capping apparatus and a recovery apparatus each for an ink jet head, with each apparatus including a cap which slips little when it closes the jet surface, and each being able to open the jet surface with the cap surface inclined.

It is another object of the invention to provide an ink jet recorder including such a recovery apparatus.

It is further another object of the invention to provide an apparatus for recovery of an ink jet head accompanied by air suction, the apparatus being able to reduce the back flow of ink into nozzle jet ports of the head when air is sucked.

It is still further another object of the invention to provide an ink jet recorder including such an apparatus.

In accordance with a first aspect of the invention, a capping apparatus is provided for an ink jet head having an jet surface. The capping apparatus includes a cap having a surface for covering the jet surface. The cap is supported by a support in such a manner that it can turn on an axis between a parallel position where the cap surface is parallel with the jet surface and an inclined position where the cap surface is inclined with respect to the jet surface. The cap is biased toward the inclined position by a bias member supported by the support. The turning axis is positioned between a first reference plane and a second reference plane. The first plane includes the surface of the cap at the parallel position. The second plane is parallel with the first plane, and includes a point on the cap surface which is nearest to the jet surface when the cap is at the inclined position.

In accordance with a second aspect of the invention, a recovery apparatus is provided for an ink jet head having an jet surface. The recovery apparatus includes a cap having a surface for covering the jet surface. The cap is connected to a suction device. The cap can be moved between a contact position and a retracted position with respect to the jet surface by a mover. The cap is supported by a support in such a manner the cap is pivotable on an axis with respect to the mover. The support is biased by a bias member so as to incline the cap surface with respect to the jet surface when the cap is at the retracted position. The pivotal axis is positioned between a first reference plane and a second reference plane. The first plane includes the surface of the cap covering the jet surface. The second plane is parallel with the first plane, and includes the contact point on the cap surface which first comes into contact with the jet surface when the cap moves from the retracted position to the contact position.

In accordance with a third aspect of the invention, an ink jet recorder is provided. The recorder comprises an ink jet head having an jet surface with jet ports formed therein. The recorder further comprises a recovery apparatus for the head. The recovery apparatus includes a cap having a surface for covering the jet surface. The cap is connected to a suction device. The cap can be moved between a contact position and a retracted position with respect to the jet surface by a mover. The cap is supported by a support such that the cap is pivotable on an axis with respect to the mover. The support is biased by a bias member so as to incline the cap surface with respect to the jet surface when the cap is at the retracted position. The pivotal axis is positioned between a first reference plane and a second reference plane. The first plane includes the surface of the cap covering the jet surface. The second plane is parallel with the first plane, and includes the contact point on the cap surface which first comes into contact with the jet surface when the cap moves from the retracted position to the contact position.

The cap of each of the apparatus and recorder according to the first, second and third aspects, respectively, is supported by the support, and biased by the bias member so as to incline the cap surface with respect to the jet surface at the retracted position. When the cap is moved from the retracted position toward the jet surface by the mover or the like, the contact point on the inclined cap which is nearest to the jet surface, that is, one end of the cap surface contacts first with the jet surface. When the cap further moves toward the jet surface, it turns on the turning or pivotal axis against the bias force so that the cap surface can cover the jet surface. When the jet surface is completely covered with the cap surface, the surfaces are parallel with each other. The axis is positioned between the first reference plane, which includes the cap surface covering the jet surface, and the second reference plane, which includes the contact point and is parallel with the first plane. Accordingly, the contact point is positioned at substantially the same height when it contacts first with the jet surface and when the jet surface is covered completely with the cap surface. As a result, the sealing part of the cap slips little during the turn of the cap. If the axis is positioned halfway between the first and second reference planes, the contact point of the cap surface can be positioned at the same height at the start and end of the turn of the cap.

When the mover is moved toward the retracted position to open the jet surface, the cap starts to be turned by the bias force to incline the cap surface relatively to the jet surface. Then, one end of the cap surface separates from the jet surface, releasing the jet surface from the sealed condition. This prevents air from being entrained by the residual negative pressure. In each of the recovery apparatus and the recorder, with the cap surface covering the jet surface, the suction device can suck the ink remaining between the surfaces and discharge it outside the cap surface.

The turning or pivotal axis may be so positioned that the cap surface as a whole turns on the axis in the same direction. For example, the jet surface may be vertical, and the axis may be horizontal and positioned above or below the cap surface. This prevents the axis from interfering with the ink jet head. It is therefore easy to position the axis.

The mover of the recovery apparatus and the recorder may move the cap, the support and the bias member as one body. This formation of the mover widens the space defined between the recovery apparatus and the adjacent side of the ink jet head after the mover moves the cap to the retracted position. As a result, the cap maintenance is easy.

In accordance with a fourth aspect of the invention, a recovery apparatus is provided for an ink jet head having a substantially vertical jet surface with jet ports formed therein at different heights. The recovery apparatus includes a cap having a surface for covering the jet surface in such a manner that the cap surface can contact with and separate from the jet surface. The cap also has a suction port formed in the cap surface, through which the ink remaining between the jet surface and the cap surface covering the jet surface can be sucked. The suction port is positioned below the jet ports. The suction port is connected to a suction device.

In accordance with a fifth aspect of the invention, an ink jet reorder is provided. The recorder comprises an ink jet head having a substantially vertical jet surface with jet ports formed therein at different heights. The recorder further comprises a recovery apparatus for the head. The recovery apparatus includes a cap having a surface for covering the jet surface in such a manner that the cap surface can contact with and separate from the jet surface. The cap also has a suction port formed in the cap surface, through which the ink remaining between the jet surface and the cap surface covering the jet surface can be sucked. The suction port is positioned below the jet ports. The suction port is connected to a suction device.

The cap surface of each of the apparatus and recorder according to the fourth and fifth aspects, respectively, covers the jet surface when the ink jet head does not operate at its waiting position. Accordingly, the jet surface is kept liquid-tight or air-tight. This prevents the jet performance from being lowered when the next printing starts by the ink drying in jet ports in the jet surface. When the ink jet head starts printing, it is recovered by being sucked by the suction device, which is connected to the suction port in the cap surface. The recovery by suction removes the ink, the air bubbles and the like existing between the cap surface and jet surface, and in jet ports. Therefore, printing can start in good condition. When the cap starts to move from the jet surface to the retracted position, it is released from the jet surface. This causes air to be sucked by the suction device such as a pump, which purges away the ink sucked from the jet ports to the space (purge chamber) between the cap surface and jet surface and adhering to the jet surface. The suction port of the cap is positioned below the jet ports. Therefore, until the air suction ends, the jet ports contact little or do not contact at all with the ink remaining in the purge chamber. This prevents the ink from being entrained and flowing back with air bubbles into the jet ports until the air suction ends due to the ink turbulence and/or air turbulence occurring when the cap is released. Accordingly, the invention can prevent defective jet of ink due to such back flow of ink.

In each of the apparatus and recorder according to the fourth and fifth aspects, respectively, it is preferable that the suction port be positioned at a predetermined distance below the jet ports. Specifically, in order that the surface of the ink sucked into the suction port when the cap is released may not contact with the bottoms of the lowest jet ports, it is preferable that the suction port be positioned below the jet ports by the distance, which may be predetermined with factors such as the suction pressure acting on the cap when the cap is released, the angle at which the cap surface and jet surface meet when the cap is released, the jet surface sizes, in particular, width, and the likelihood of ink leakage. This preferable formation perfectly prevents the ink from being entrained and flowing back with air bubbles into the jet ports until the air suction ends due to the ink turbulence and/or air turbulence occurring when the cap is released. It is therefore possible to securely prevent defective jet due to such back flow of ink.

It is preferable that the apparatus and the recorder according to the fourth and fifth aspects, respectively, further include a support supporting the cap in such a manner that the cap can turn between a parallel position where the cap surface is parallel with the jet surface and an inclined position where the cap surface is inclined with its lower part protruding toward the jet surface, a mover for moving the cap between a contact position and a retracted position with respect to the jet surface, and a bias member biasing the cap toward the inclined position. The cap surface should be pressed against the jet surface so as to be at the parallel position when the mover is at the contact position. An upper part of the cap surface should start to separate from the jet surface when the mover starts to move toward the retracted position.

Such construction, when the cap starts moving from the contact position to the retracted position, causes the top of the cap surface to start separating from the jet surface, and the cap surface to incline. As a result, the flow of (outside) air from above into the space between the cap surface and jet surface reduces the negative pressure developing between the surfaces when the cap is released.

In the preferable construction, it is more preferable that the suction port be positioned below the jet ports when the upper part of the cap surface is away from the jet surface and when the lower part of the cap surface is in contact with the jet surface. This more effectively prevents the ink from being entrained and flowing back with air bubbles into the jet ports due to the air turbulence caused by the air flowing from above into the space between the cap surface and jet surface when the cap is released.

In the more preferable construction, the suction device may also suck when the mover starts to move toward the retracted position. This suction can securely remove the ink, the air bubbles and the like between the cap surface and jet surface, and in jet ports.

In each of the apparatus and recorder according to the invention, the cap may include a recessed elastic body. When the cap is at the contact position, the elastic body can keep the jet surface and cap surface in sufficiently liquid-tight or air-tight contact with each other.

The invention may be applied to a color ink jet printer or the like including ink jet heads for jetting ink in different colors and caps each associated with one of the heads.

BRIEF DESCRIPTION OF THE DRAWINGS

Preferred embodiments of the present invention will be described with reference to the accompanying drawings, in which.

DETAILED DESCRIPTION OF THE EMBODIMENTS

Embodiment 1

Figure 1:
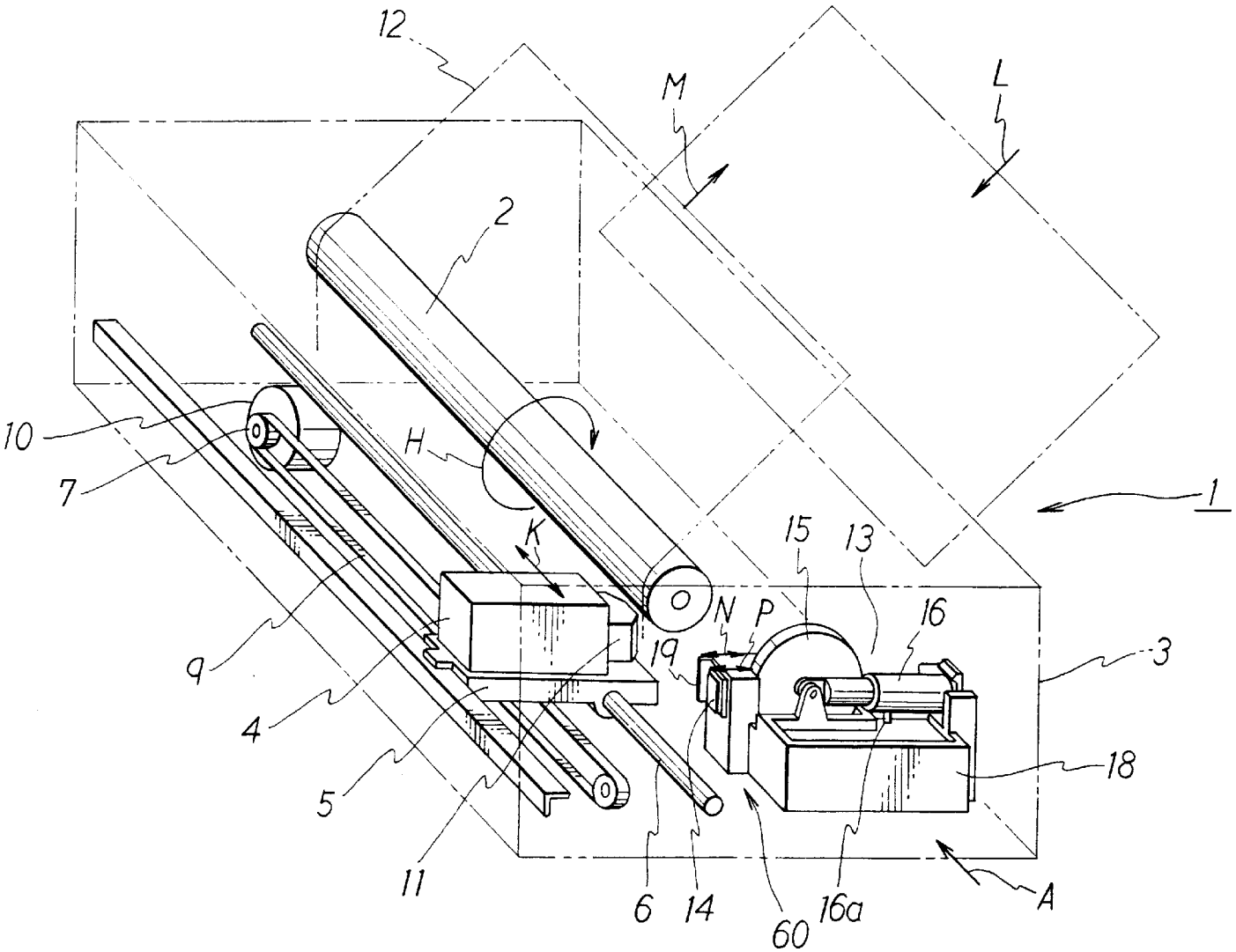
FIG. 1 is a perspective view schematically showing the structure of an ink jet printer according to the first embodiment.

With reference to FIG. 1, an ink jet printer 1 includes a cylindrical platen 2 extending horizontally. The platen 2 is supported rotatably in the direction H by a shaft (not shown) on a frame 3.

A guide rod 6 extends in parallel with the platen 2, and is fixed to the frame 3. A carriage 5 is supported slidably on the rod 6. A recording head 4 is mounted on the carriage 5 in such a manner that it faces the platen 2. A pair of pulleys 7 and 8 are supported by the frame 3. A timing belt 9 extends between the pulleys 7 and 8, and is connected to the carriage 5. A carriage drive motor 10 can rotate the pulley 7 to drive the belt 9 so that the carriage 5 moves in the directions K along the platen 2.

The recording head 4 can reciprocate within a predetermined recording range along the platen 2, and includes jet head 11 as a head portion. Jet head 11 has a number of ink passages or channels (not shown) and a number of jet ports (not shown) each associated with one of the passages. The passages can be supplied with ink from an ink supply unit (not shown), which may be fixed to the frame 3 or mounted on the carriage 5. Part of the wall of each of the passages is formed by a diaphragm (not shown). When the diaphragm is deformed by a drive circuit (not shown) in accordance with a command from a control unit (not shown), the pressure change resulting from the deformation ejects ink from the associated jet port. While the carriage 5 is moving, ink is jetted onto recording paper 12 fed between the platen 2 and recording head 4. During a stroke of the carriage 5, a line of an image is formed. After an image line is formed, the platen 2 turns to feed the paper 12 by one line, and then another image line is formed. By repeating this, it is possible to form an image on the whole paper 12. The paper 12 can be fed in the direction L through a paper feed port (not shown) behind the frame 3, and turned in the direction M by the platen 2. The turned paper 12 is discharged through a discharge port (not shown).

After recording operation as described above, the recording head 4 is returned to its non-recording position, where it faces a recovery apparatus 13. The recovery apparatus is mainly composed of a capping apparatus 60 and pump 16. This apparatus 13 is placed on one side of the platen 2, and fixed to the frame 3. The apparatus 13 includes a rubber cap 14, which has rectangular suction recess or cavity associated with the jet head 11. Recess 24 is defined by a rectangular brim 14*a*. When the carriage 5 has, after printing operation stops, moved to the position where it faces the recovery apparatus 13, the cap 14 is moved by a cam 15 etc. so as to engage liquid-tightly with the jet head 11.

Figure 2A:
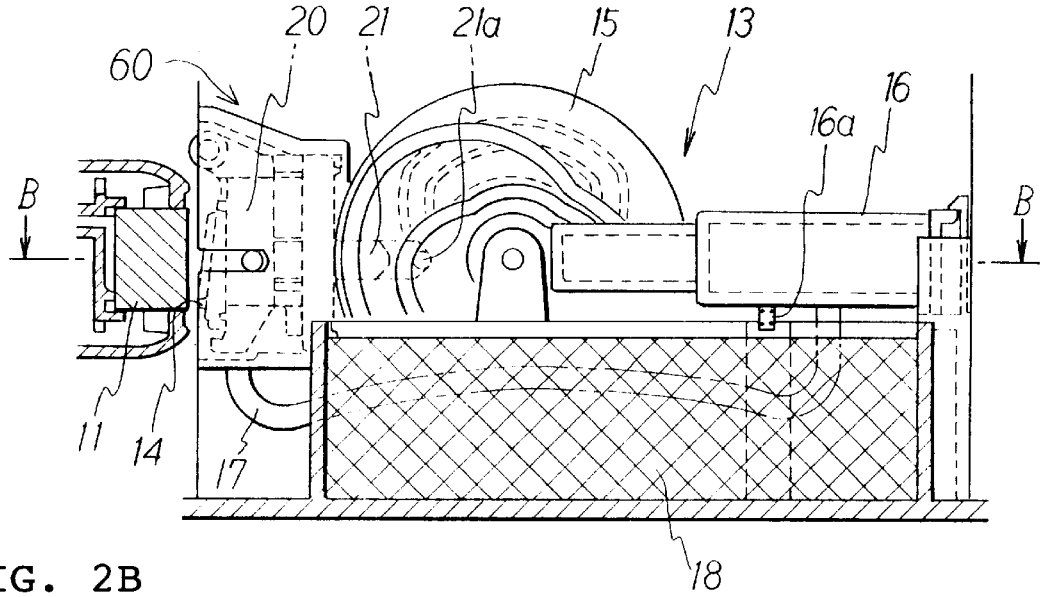
FIG. 2A is a partial side view, partially in section, seen in the direction A of FIG. 1.

As shown in FIG. 2A, the suction recess of the cap 14 is connected through tube 17 to a pump 16, which can be operated by the cam 15. The thickened ink in the jet head 11 can be sucked through the recess of the cap 14 engaging with the jet head 11. The sucked ink is discharged through a discharge port 16*a* into a foamed body 18 for absorbing the waste liquid.

Adjacently to the recovery apparatus 13, a wiper is fixed to the frame 3. The wiper includes a rubber blade 19. In accordance with the turn of the cam 15, the wiper blade 19 can reciprocate in the directions N in FIG. 1 to wipe away the ink remaining on the front end surfaces of the jet head 11 after the suction by the pump 16.

The recovery apparatus 13 of this embodiment will be described below in detail.

Figure 2B:
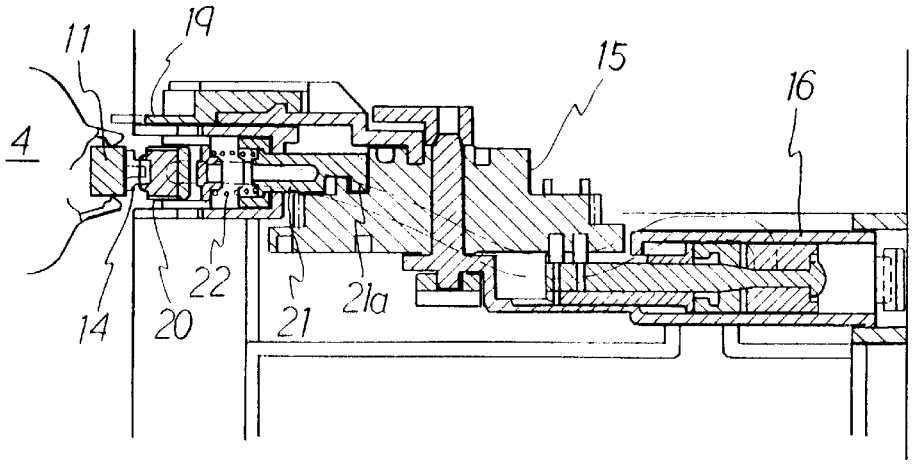
FIG. 2B is a partial cross section taken along the line B—B of FIG. 2A.
Figure 3:
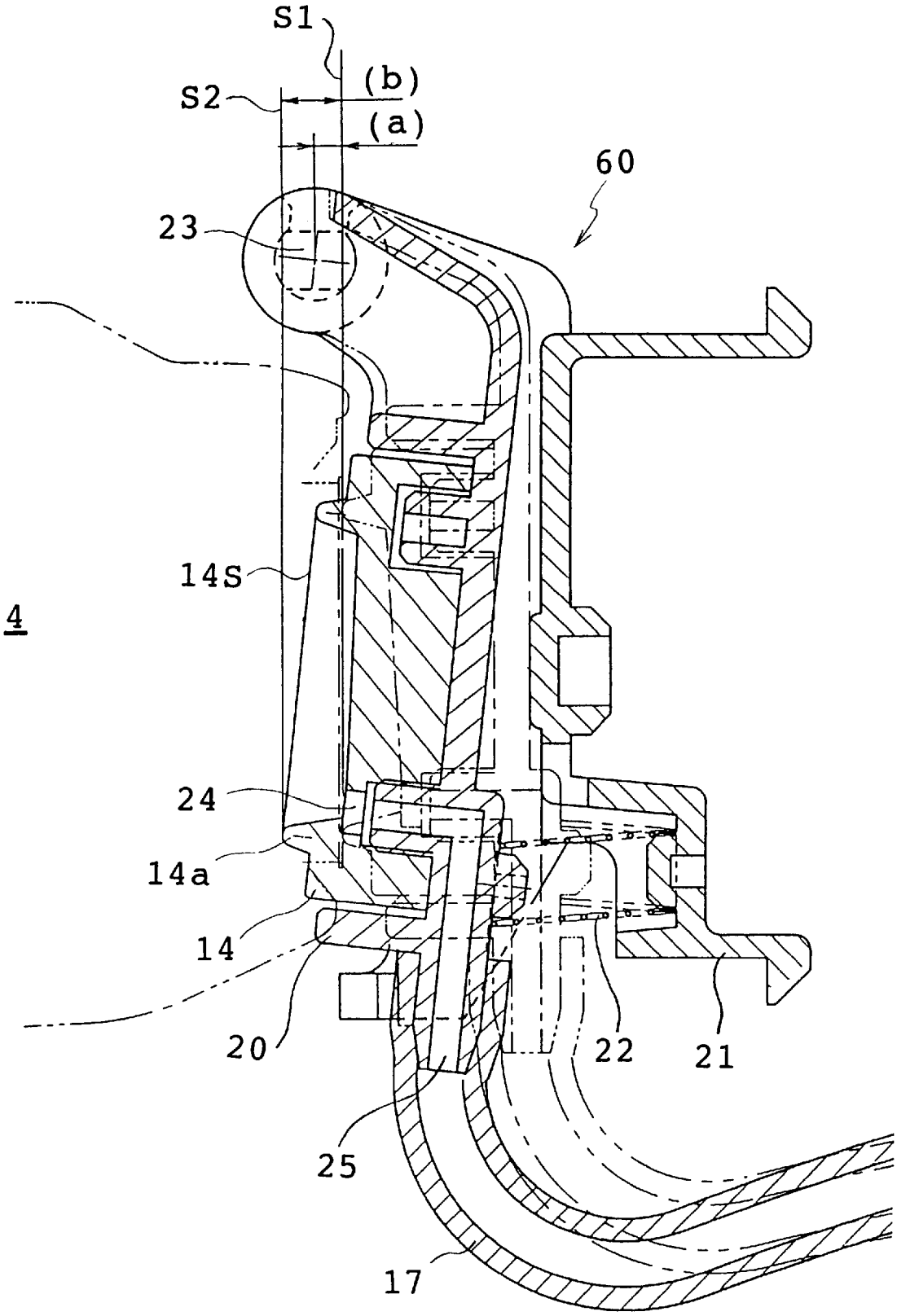
FIG. 3 is an enlarged partial cross section of the recovery apparatus in the printer according to the first embodiment, showing the position of the pivotal pin of the support fitted to the apparatus.

As shown in FIGS. 2A and 2B, the cap 14 is mounted on a support 20. The support 20 is supported by a mover 21 with a spring 22 biasing the support 20 toward the recording head 4. The mover 21 is fitted with a cam follower 21*a*, which engages with the cam 15. As shown in FIG. 3, the support 20 is supported pivotably on a horizontal pin 23, which is fixed to the mover 21. When the cap 14 is away from the jet head 11, the support 20 is inclined relatively to the jet surface as shown with solid lines in FIG. 3.

As shown in FIG. 3, suction recess 24 of the cap 14 communicates with a communicating port 25, which is connected through the associated tube 17 to the pump 16 as stated earlier.

The operation of the capping apparatus 60 and the recovery apparatus 13 will be described below with reference to FIG. 4.

Figure 4A:
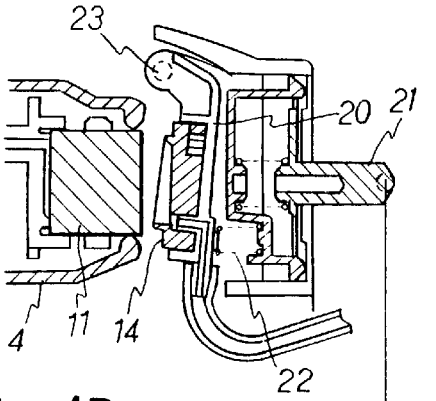
FIGS. 4A–4F are partial cross sections of the printer according to the first embodiment, showing the operation of the recovery apparatus.

First, when the recording head 4 has moved to the nonrecording position, the mover 21 is at a retracted position away from the recording head 4 as shown in FIG. 4A. At the retracted position, the support 20 biased by the spring 22 is inclined so that the front surface of the cap 14 is inclined relatively to the front surface of the jet head 11.

Figure 4B:
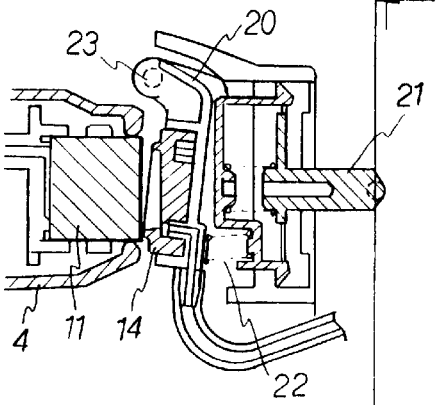

Then, the cam 15 is actuated to move the mover 21 so that the support 20 and cap 14 are moved toward the jet head 11. As a result, the cap 14 reaches a position, as shown in FIG. 4B, for contact with the jet head 11. At this contact position, part of the cap 14 contacts with the jet surface.

Figure 4C:
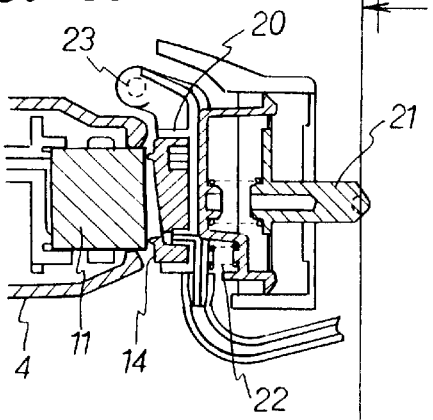
Figure 4D:
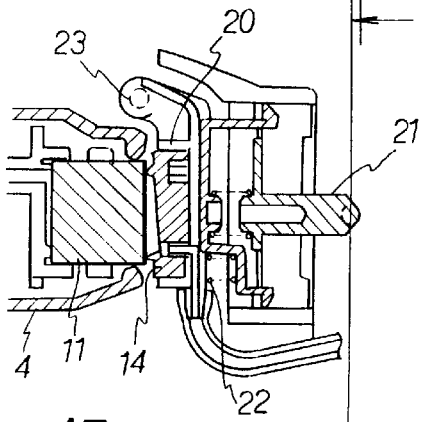

As shown in FIG. 4C, further movement of the mover 21 causes the support 20 to pivot on the horizontal pin 23 so that the overall front surface of the cap 14 cover the jet surface. As shown in FIG. 4D, still forced movement of the mover 21 brings the cap surface into compressive contact with the jet surfaces. Under this condition, the pump 16 sucks the ink in the jet head 11.

Figure 4E:
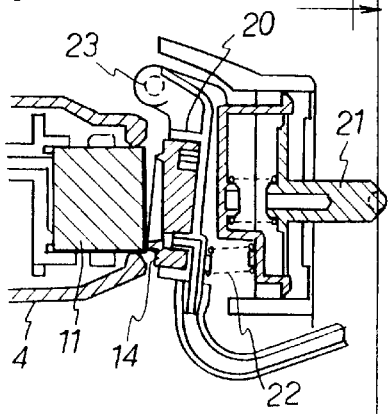

After the ink is sucked and until recording operation starts, the jet ports of the jet head 11 are still kept sealed with the cap 14 so as to be prevented from drying and protected from dust etc. When recording operation starts, as shown in FIG. 4E, the cam 15 is actuated to move the mover 21 toward the retracted position so that the support 20 moves away from the jet head 11. Consequently, as shown in FIG. 4E, the support 20 pivots to incline the cap surface because, as stated before, the support 20 can pivot on the horizontal pin 23 and is biased relatively to the mover 21 by the spring 22. This moves the cap 14 gradually away from the jet surface, gradually opening the closed jet surface. Therefore, no air is entrained.

Figure 4F:
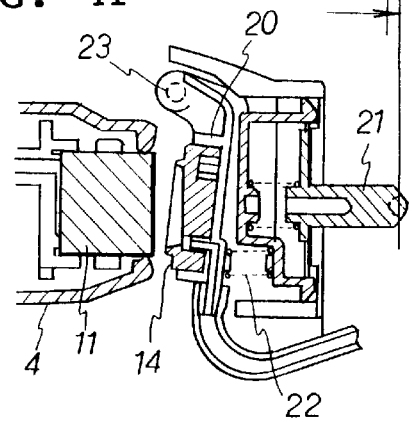
Figure 5:
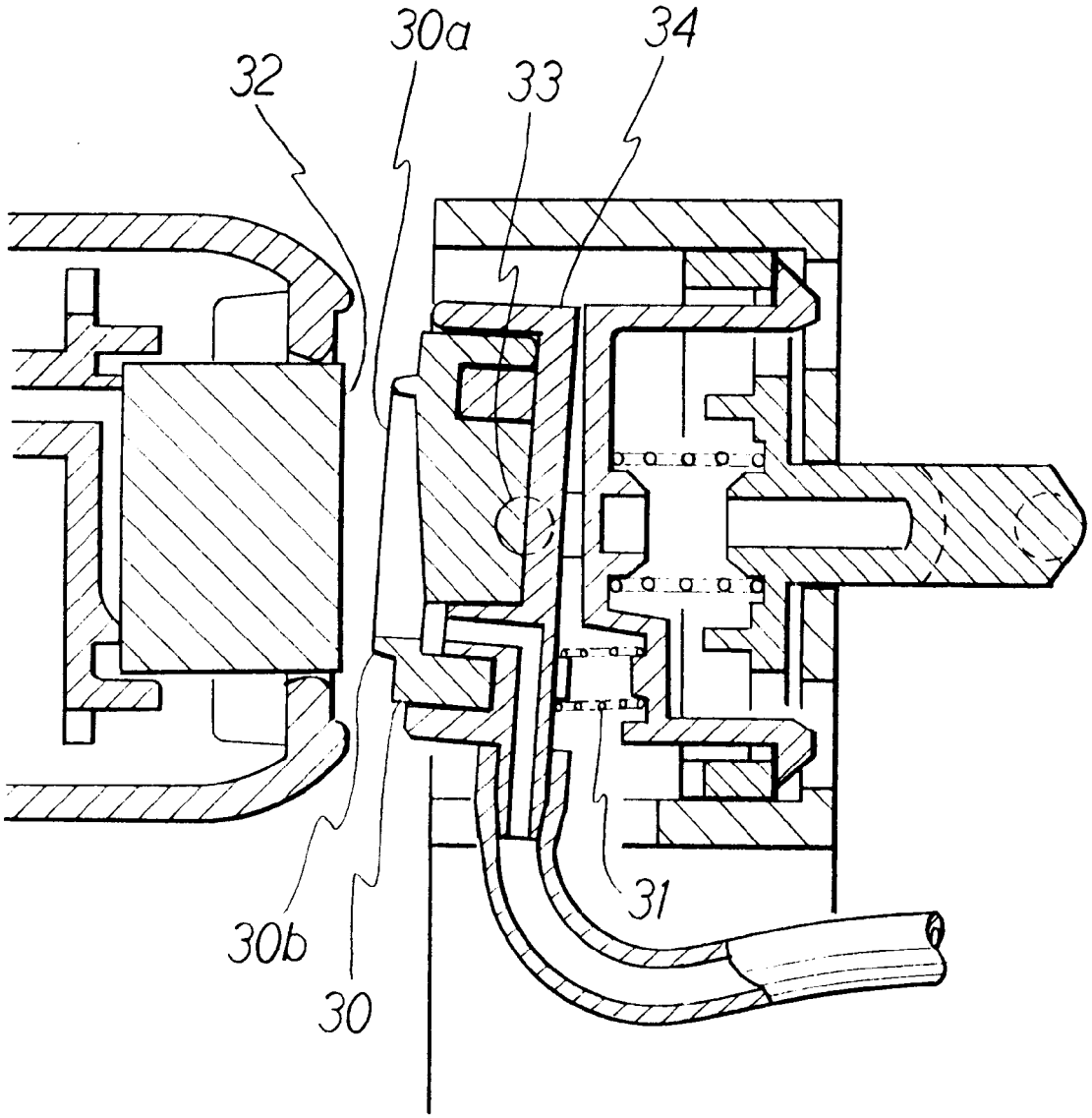
FIG. 5 PRIOR ART
FIG. 5 is a cross section schematically showing the structure of a conventional recovery apparatus.

As shown in FIG. 4F, the movement of the mover 21 to the retracted position separates the cap 14 completely from the jet head 11. This completes the recovery operation. Thus, the mover 21 moves the cap 14, support 20 and spring 22 as one body. Therefore, when the recovery operation has ended, a predetermined space is formed between the recovery apparatus 13 and jet head 11. This provides a space for maintenance and the like of the cap after the recording head 4 moves toward the recording position.

After the cap 14 starts to contact with the jet head 11, as shown in FIG. 4B, and until it closes their surfaces, as shown in FIG. 4C, it and the support 20 pivot on the horizontal pin 23. Because the axis of the pin 23 is positioned as shown in FIG. 3, the shifts or slips of the brim 14*a* of the cap are extremely small. With reference to FIG. 3, the position of the axis of the pin 23 will be explained below in detail.

In FIG. 3, the vertical position of the support 20 shown with two-dot chain lines is where the support 20 covers the jet surface with the cap 14 in complete contact with the jet head 11, and the inclined position of the support 20 shown with solid lines is where the cap 14 starts to contact with the jet surface. S1 represents the reference plane including the cap surface at the vertical position of the support 20 (in complete contact of the cap 14 with the jet surface). S2 represents the reference plane in parallel with the plane S1 and including the contact point (line) of the cap brim 14*a* at the inclined position of the support 20. The axis of the horizontal pin 23 is positioned between the planes S1 and S2. The distance "a" between the axis of the horizontal pin 23 and plane S1 is shorter than the distance "b" between the planes S1 and S2. The contact line of the brim 14*a* describe circular locus around the axis when the support 20 pivots. The pivoting angle is very small. Therefore, if the axis of the pin 23 is set at the foregoing position, there is little vertical slippage of the brim 14*a* on the jet surface.

Consequently, even if such pivotal movement occurs frequently, the brim 14*a* does not deform, but can still contact closely with the jet surface. Further, because the slippage is small, the jet surface can be small. This contributes to reduction of the apparatus size and costs.

In this embodiment, the axis of the horizontal pin 23 is set at an arbitrary position between the reference planes S1 and S2. It is more preferable that the pin axis be set in the middle between the planes S1 and S2 so that there is no slippage of the brim 14*a* on the jet surfaces.

The vertical position of the horizontal pin 23 is not particularly limited. However, if the pin 23 is set, as shown in FIG. 3, at such a position that the front surfaces of the cap 14 can turn in the same direction, the pin 23 can be fitted at a position without interference with the jet head 11, as shown in FIG. 3. This reduces the locational restriction of the recovery apparatus 13.

In this embodiment, the present invention is applied to the cap mechanism of a suction apparatus. The invention may, however, also be applied to protective capping apparatus without a function of suction. In this case, the invention is effective particularly in preventing pressurized air from being entrained into the nozzle when the cap contacts closely with the jet surface.

Embodiment 2

Figure 2C:
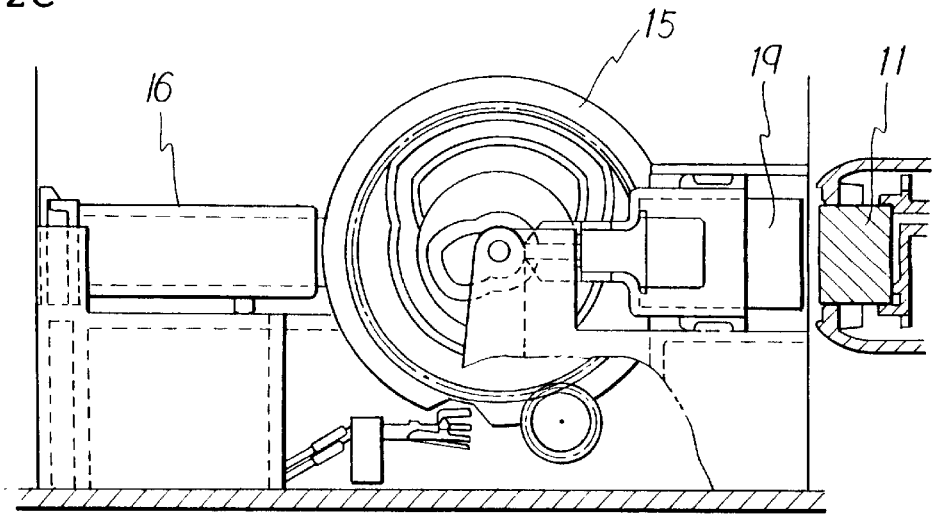
FIG. 2C is a partial side view, partially in section, seen in the direction opposite to the direction A of FIG. 1.

An ink jet printer according to this embodiment has overall structure as shown in FIGS. 1 and 2. The structure described with reference to FIGS. 1 and 2 will not be omitted to avoid an overlapped explanation.

Figure 6:
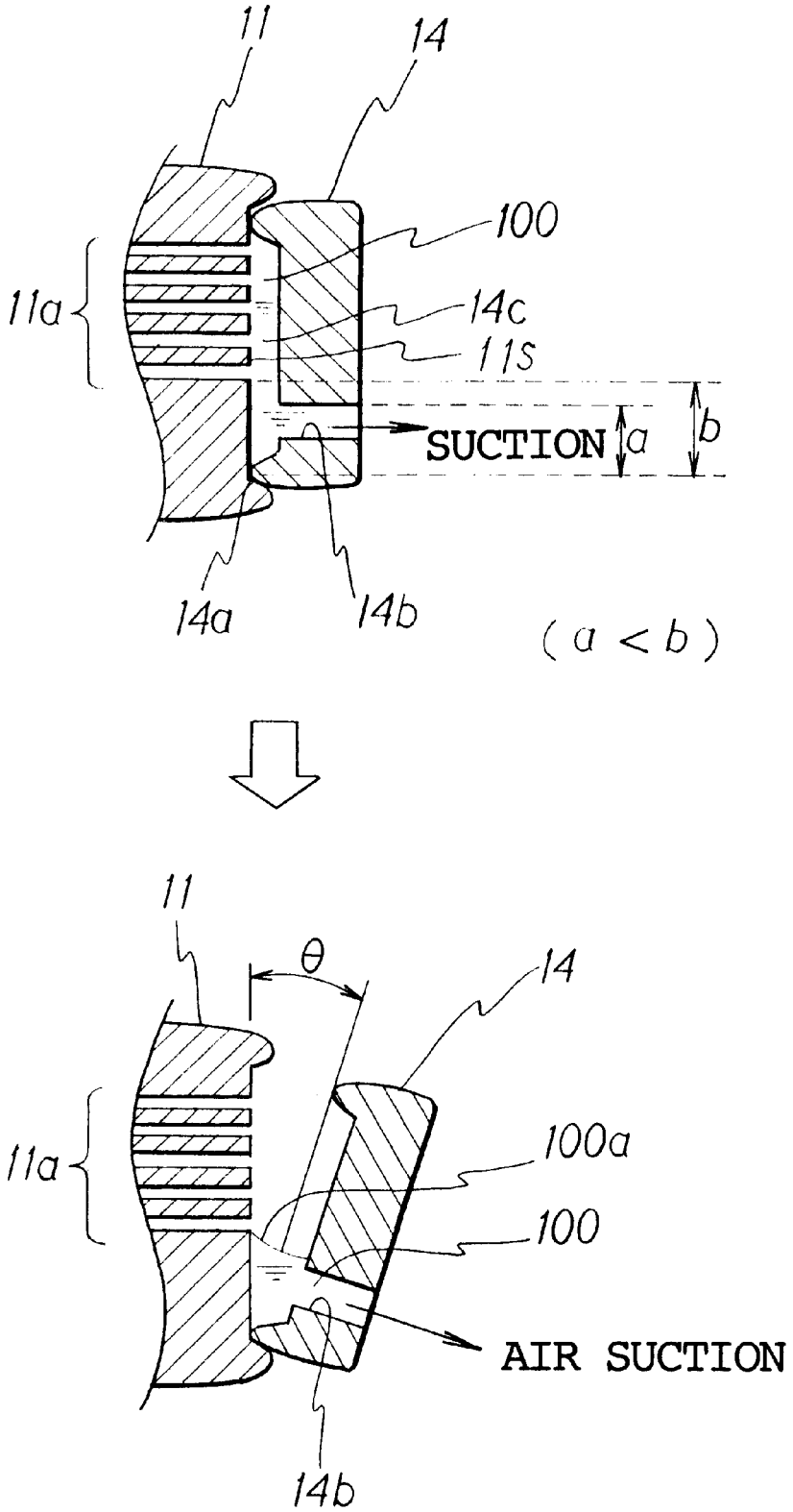
FIG. 6 is fragmentary cross sections of an ink jet printer according to the second embodiment, showing the structure and operation of the cap fitted to the recovery apparatus in this printer.

In particular, as shown in FIG. 6, the cap 14 of the recovery apparatus 13 according to this embodiment has suction port 14*b* formed through it below the jet ports 11*a* of the jet head 11. Specifically, the vertical distance "a" between the top of suction port 14*b* and the bottom of brim 14*a* is shorter than the vertical distance "b" between the bottom of each lowest jet port 11*a* and the bottom of the brim 14*a* (a<b).

As shown in the lower half of FIG. 6, it is more preferable that the surface 100*a* of the ink 100 be lower than the lowest jet port 11*a* when the top of the cap 14 is opened by an angle θ and air starts to be sucked. Specifically, it is preferable that the suction port 14*b* be formed in the cap surfaces below the jet port 11*a* by a distance predetermined with factors such as the suction pressure acting on the cap 14 when the cap is released, the opening angle θ, the size, in particular, the width of the jet surface, and the wettability of the ink 100. The predetermined distance may be found experimentally or with technique such as computer simulation, charts and manual calculation.

Figure 9:
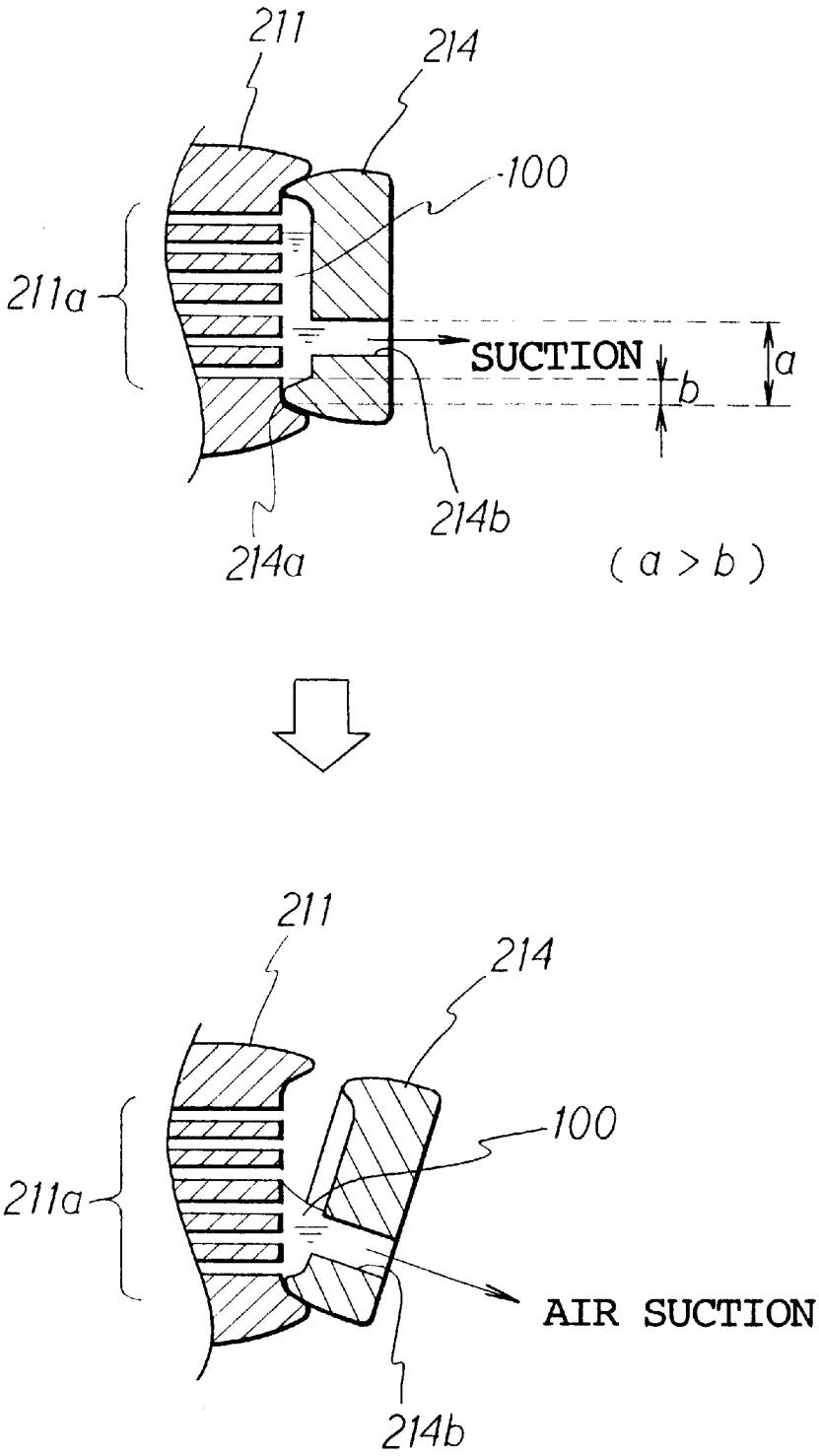
FIG. 9 PRIOR ART
FIG. 9 is fragmentary cross sections showing the structure and operation of the cap fitted to a conventional recovery apparatus.

Therefore, until the air suction ends, the ink 100 is prevented from being entrained and flowing back (refer to FIG. 9) together with air bubbles into the jet port 11*a* due to the ink turbulence and/or air turbulence occurring in the purge chamber 14*c* when the cap 14 is released.

The recovery apparatus 13 of this embodiment will be described below in detail.

As shown in FIGS. 2A and 2B, the cap 14 is mounted on a support 20. The support 20 is supported by a mover 21 and biased by a spring 22. The mover 21 is fitted with a cam follower 21*a*, which engages with a cam 15.

Figure 7:
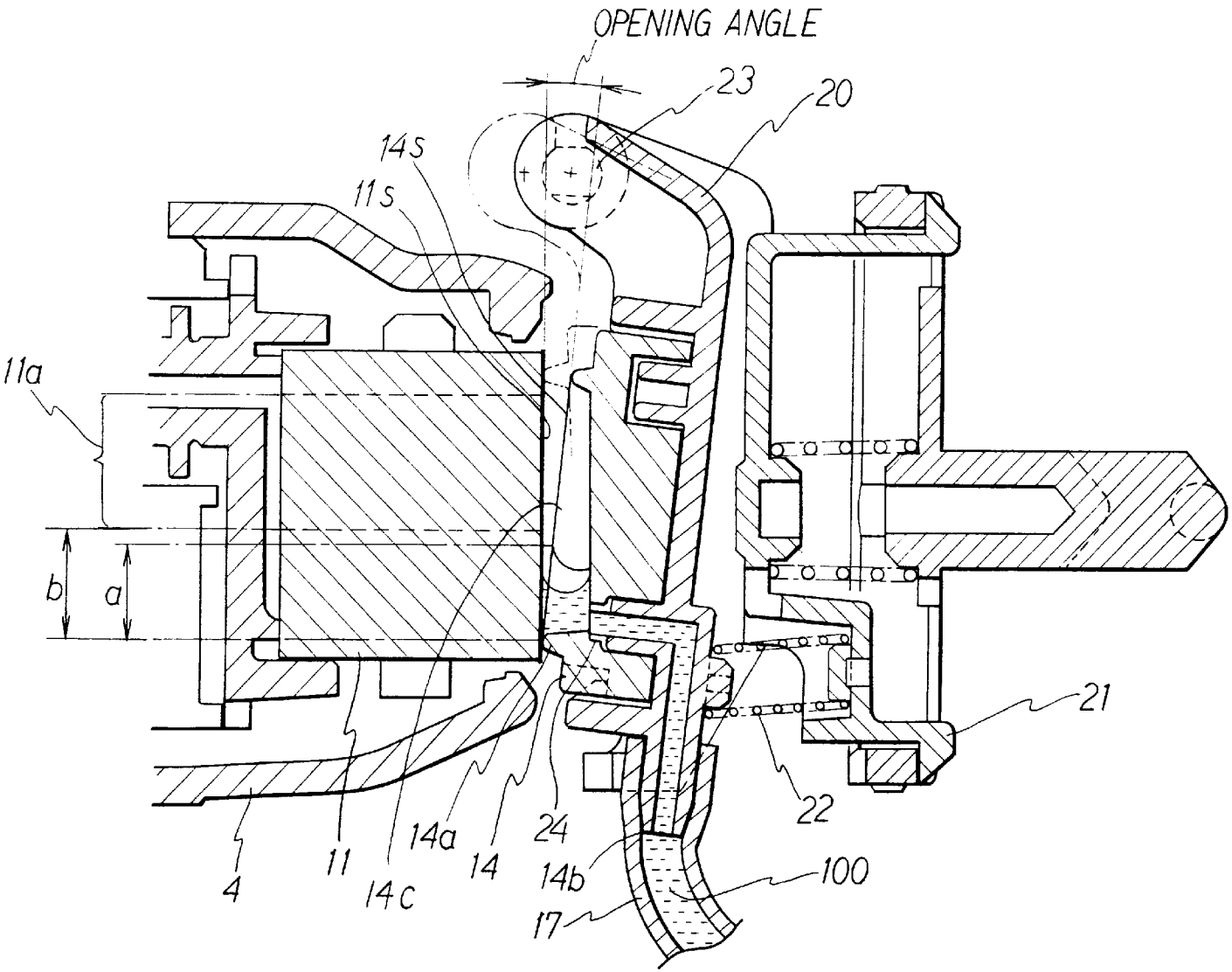
FIG. 7 is an enlarged partial cross section of the printer according to the second embodiment, showing the recovery apparatus sucking air.

As shown in FIG. 7, the support 20 can pivot 23 relatively to the mover 21. When at least part of the cap 14 is away from the jet head 11, the support 20 is inclined relatively to the jet surface, as shown with solid lines in FIG. 7. When the cap 14 is in contact with the jet head 11, the support 20 is parallel with the jet surface, as shown with two-dot chain lines in FIG. 7. As explained with reference to FIGS. 3 and 4 for Embodiment 1, the axis of the pivotal pin 23 on the support 20 of this embodiment is positioned between the first reference plane including the front surface 14S of the cap 14 at the position where the cap covers the jet surface 11S and the second reference plane in parallel with the first plane and including the contact line on the cap where part of the cap 14 contacts first with the jet surface 11S.

As shown in FIG. 7, the cap 14 has suction recess 24 communicating with the suction port 14*b*, which is connected through tube 17 to a pump 16.

The operation of the recovery apparatus of this embodiment will be described with reference to FIGS. 8A–8F.

Figure 8A:
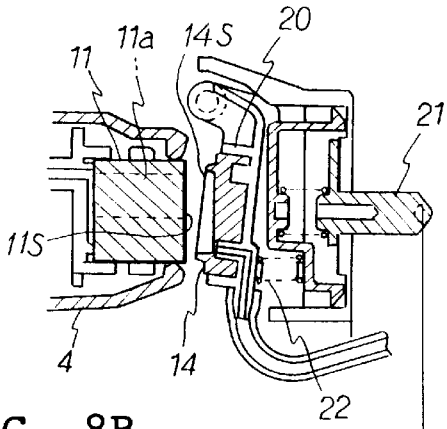
FIGS. 8A–8F are partial cross sections of the printer according to the second embodiment, showing the operation of the recovery apparatus.

When the recording head 4 has moved to its nonrecording position, as shown in FIG. 8A, the mover 21 is at its retracted position relative to the recording head 4. At the retracted position, the support 20 biased by the spring 22 is inclined so that the front surface 14S of the cap 14 are inclined relatively to the jet surface 11S.

Figure 8B:
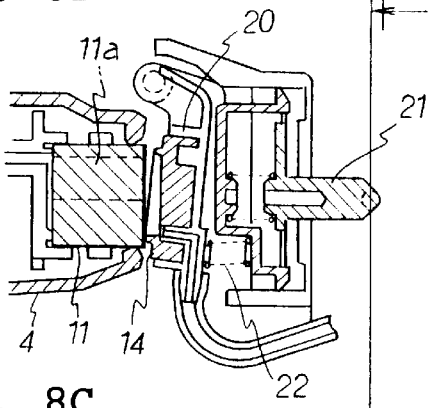

Then, the cam 15 is actuated to move the mover 21 so that the support 20 is moved together with the cap 14 toward the jet head 11. As a result, the cap 14 reaches a position, as shown in FIG. 8B, for contact with the jet head 11. At this contact position, part of the cap brim 14*a* (FIG. 7) contacts with the jet surface 11S.

Figure 8C:
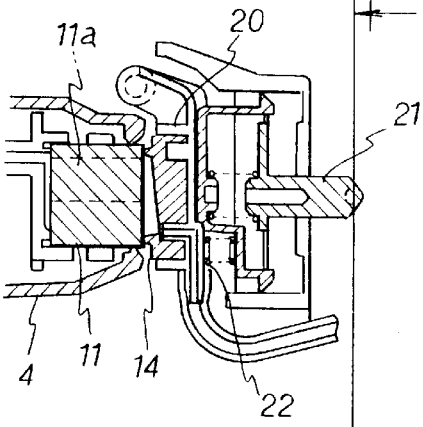
Figure 8D:
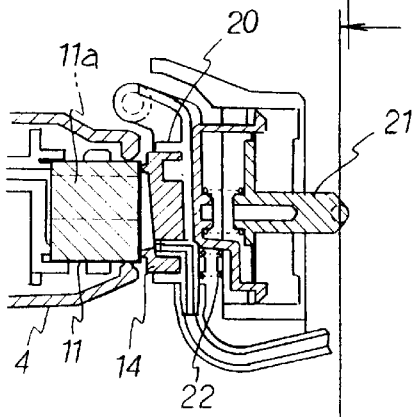

As shown in FIG. 8C, further movement of the mover 21 causes the support 20 to pivot so that the overall front surface of the cap 14 cover the jet surface. As shown in FIG. 8D, still forced movement of the mover 21 brings the cap surface into compressive contact with the jet surface. Under this condition, the pump 16 sucks the ink in the jet head 11.

Figure 8E:
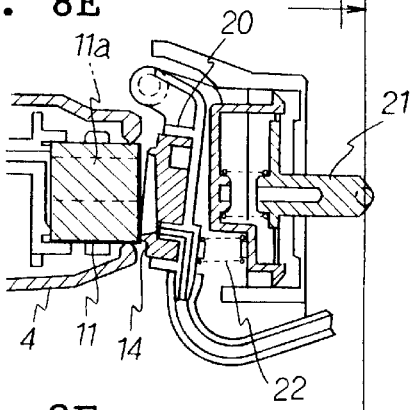

After the ink is sucked and until recording operation starts, the jet ports of the jet head 11 are still kept sealed with the cap 14 so as to be prevented from drying and protected from dust etc. When recording operation starts, as shown in FIG. 8E, the cam 15 is actuated to move the mover 21 toward the retracted position so that the support 20 moves away from the jet head 11. Consequently, the support 20 pivots to incline the cap surfaces because, as stated above, the support 20 can pivot and is biased relatively to the mover 21 by the spring 22. This moves the cap 14 gradually away from the jet surfaces so as to open the cap 14 from above, gradually opening the closed jet surfaces. Therefore, no air is entrained.

Figure 8F:
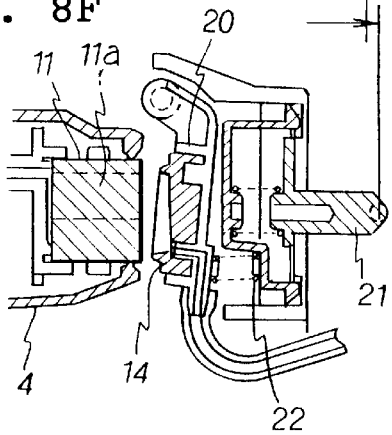

The mover 21 is moved toward the retracted position with the negative pressure in the purge chambers 14*c* of the cap 14 sufficiently lowered by the suction. This pressure may be lower than 0.05 atm. This, as shown in FIG. 8E, opens the cap 14 from the upper portion thereof, causing air to be sucked by the pump 16, as shown in detail in FIG. 7. Thereafter, as shown in FIG. 8F, the cap 14 is separated completely from the jet head 11, and the recovery operation ends. Thus, the mover 21 moves the cap 14, support 20 and spring 22 as one body. Therefore, when the recovery operation has ended, a predetermined space is formed between the recovery apparatus 13 and jet head 11. This provides a space for maintenance and the like after the recording head 4 moves toward the recording position.

As explained with reference to FIG. 6, the vertical distance "a" between the top of suction port 14*b* and the bottom of brim 14*a* is shorter than the vertical distance "b" between the bottom of the lowest jet port 11*a* and the bottom of the brim 14*a* (a<b). Therefore, during the air suction shown in FIG. 8E, the jet ports 11*a* hardly contact or do not contact at all with the ink 100 remaining in the purge chamber 14*c*. Consequently, until the air suction ends, the ink 100 is prevented from being entrained and flowing back with air bubbles into the jet ports 11*a* due to the ink turbulence and/or air turbulence occurring when the cap 14 is released. Accordingly, the present invention can prevent defective jet of ink from being caused by the ink which would otherwise flow back.

In these embodiments, the present invention is applied to a recovery apparatus for a monochrome ink jet printer, which includes an ink A with a single jet nozzle. However, the invention is not limited to this, but may also be applied to recovery apparatus for color ink jet heads each including a number of jet nozzles, and for line heads each including a line of jet nozzles. In such cases, a mechanism for moving a cap may be provided for each nozzle. Alternatively, a single mechanism may be provided for moving a plurality of caps, which are connected to a pump. In this case, the nozzles can be moved to the cap position, where oil is sucked, so that each cap can prevent one of the nozzles from drying.

What is claimed is:

1. A capping apparatus for an ink jet head, which has an jet surface, the apparatus comprising:

a cap having a surface for covering the jet surface;

a support supporting the cap in such a manner that the cap can turn on an axis between a parallel position where the cap surface is parallel with the jet surface and an inclined position where the cap surface is inclined with respect to the jet surface; and a bias member biasing the cap toward the inclined position;

the turning axis being positioned between a first reference plane and a second reference plane, the first plane including the surface of the cap at the parallel position, the second plane being parallel with the first plane and including a point on the cap surface which is nearest to the jet surface when the cap is at the inclined position.

2. The capping apparatus of claim 1, wherein the jet surface is substantially vertical, the turning axis being substantially horizontal and positioned above or below the cap surface.

3. The capping apparatus of claim 1, wherein the turning axis is positioned halfway between the first and second reference planes.

4. The capping apparatus of claim 1, wherein the cap is at the parallel position when the cap surface covers the jet surface, the cap being inclined before the cap surface covers the jet surface, the point on the cap surface first coming into contact with the jet surface when the cap surface covers the jet surface.

5. The capping apparatus of claim 4, wherein the jet surface is substantially vertical, the point on the cap surface being positioned at the same height when the cap is at the parallel and inclined positions.

6. The capping apparatus of claim 1, wherein the jet surface is substantially vertical and has a plurality of jet ports formed at different heights, the cap having a suction port through which the ink remaining between the jet surface and the cap surface covering the jet surface can be sucked out of the cap, the suction port being positioned below the jet ports.

7. The capping apparatus of claim 6, wherein the suction port is positioned at a predetermined distance below the jet ports.

8. A recovery apparatus for an ink jet head, which has an jet surface, the apparatus comprising:

a cap having a surface for covering the jet surface;

a suction device connected to the cap;

a mover for moving the cap between a contact position and a retracted position with respect to the jet surface;

a support supporting the cap pivotably on an axis with respect to the mover; and a bias member biasing the support so as to incline the cap surface with respect to the jet surface when the cap is at the retracted position;

the pivotal axis being positioned between a first reference plane and a second reference plane, the first plane including the surface of the cap covering the jet surface, the second plane being parallel with the first plane and including a contact point on the cap surface which first comes into contact with the jet surface when the cap moves from the retracted position to the contact position.

9. The recovery apparatus of claim 8, wherein the jet surface is substantially vertical and has a plurality of jet ports formed at different heights, the cap having a suction port through which the ink remaining between the jet surface and the cap surface covering the jet surface can be sucked out of the cap by the suction device, the suction port being positioned below the jet ports.

10. The recovery apparatus of claim 9, wherein the suction port is positioned at a predetermined distance below the lowest jet port.

11. The recovery apparatus of claim 8, wherein the pivotal axis is so positioned that the cap surface as a whole turns on the axis in the same direction.

12. The recovery apparatus of claim 8, wherein the pivotal axis is positioned halfway between the first and second reference planes.

13. The recovery apparatus of claim 8, wherein the mover can move the cap, the support and the bias member as one body.

14. The recovery apparatus of claim 8, wherein the mover includes a cam for moving the mover between the contact and retracted positions.

15. The recovery apparatus of claim 8, wherein the ink jet head includes a plurality of heads for jetting ink in different colors, the apparatus comprising a plurality of caps each associated with one of the heads.

16. A recovery apparatus according to claim 8, wherein the pivotal axis is in a fixed position relative to the mover.

17. An ink jet recorder comprising an ink jet head, which has an jet surface with a plurality of jet ports, and a recovery apparatus for the head, the apparatus including:

a cap having a surface for covering the jet surface;

a suction device connected to the cap;

a mover for moving the cap between a contact position and a retracted position with respect to the jet surface;

a support supporting the cap pivotably on an axis with respect to the mover; and a bias member biasing the support so as to incline the cap surface with respect to the jet surface when the cap is at the retracted position;

the pivotal axis being positioned between a first reference plane and a second reference plane, the first plane including the surface of the cap covering the jet surface, the second plane being parallel with the first plane and including a contact point on the cap surface which first comes into contact with the jet surface when the cap moves from the retracted position to the contact position.

18. The ink jet recorder of claim 17, wherein the jet surface is substantially vertical, the cap having a suction port through which the ink remaining between the jet surface and the cap surface covering the jet surface can be sucked out of the cap by the suction device, the suction port being positioned below the jet ports.

19. The ink jet recorder of claim 18, wherein the suction port is positioned at a predetermined distance below the lowest jet port.

20. The ink jet recorder of claim 17, wherein the pivotal axis is so positioned that the cap surface as a whole turns on the axis in the same direction.

21. The ink jet recorder of claim 17, wherein the pivotal axis is positioned halfway between the first and second reference planes.

22. The ink jet recorder of claim 17, wherein the mover can move the cap, the support and the bias member as one body.

23. The ink jet recorder of claim 17, wherein the mover includes a cam for moving the mover between the contact and retracted positions.

24. The ink jet recorder of claim 17, wherein the ink jet head includes a plurality of heads for jetting ink in different colors, the recovery apparatus including a plurality of caps each associated with one of the heads.

25. An ink jet recorder according to claim 17, wherein the pivotal axis is in a fixed position relative to the mover.

26. A recovery apparatus for an ink jet head, which has a substantially vertical jet surface with a plurality of jet ports formed at different heights, the apparatus comprising:

a cap having a surface for covering the jet surface in such a manner that the cap surface can contact with and separate from the jet surface, the cap having a suction port through which the ink remaining between the jet surface and the cap surface covering the jet surface can be sucked, the suction port being positioned below the lowest jet port; and a suction device connected to the suction port.

27. The recovery apparatus of claim 26, wherein the suction port is positioned at a predetermined distance below the lowest jet port.

28. The recovery apparatus of claim 26, further comprising:

a support supporting the cap in such a manner that the cap can turn between a parallel position where the cap surface is parallel with the jet surface and an inclined position where the cap surface is inclined with its lower part protruding toward the jet surface;

a mover for moving the cap between a contact position and a retracted position with respect to the jet surface; and a bias member biasing the cap toward the inclined position;

the cap surface being pressed against the jet surface so as to be at the parallel position when the mover is at the contact position of the cap, and an upper part of the cap surface starting to separate from the jet surface when the mover starts to move toward the retracted position of the cap.

29. The recovery apparatus of claim 28, wherein the suction port is positioned below the lowest jet port.

30. The recovery apparatus of claim 29, wherein the suction device sucks when the mover starts to move toward the retracted position of the cap.

31. The recovery apparatus of claim 26, wherein the cap includes a recessed elastic body.

32. An ink jet recorder comprising:

an ink jet head, which has a substantially vertical jet surface with a plurality of jet ports formed at different heights, and a recovery apparatus for the head, the apparatus including;

a cap having a surface for covering the jet surface in such a manner that the cap surface can contact with and separate from the jet surface, the cap having a suction port through which the ink remaining between the jet surface and the cap surface covering the jet surface can be sucked, the suction port being positioned below the lowest jet port, and a suction device connected to the suction port.

33. The ink jet recorder of claim 32, wherein the suction port is positioned at a predetermined distance below the lowest jet port.

34. The ink jet recorder of claim 32, further comprising:

a support supporting the cap in such a manner that the cap can turn between a parallel position where the cap surface is parallel with the jet surface and an inclined position where the cap surface is inclined with its lower part protruding toward the jet surface;

a mover for moving the cap between a contact position and a retracted position with respect to the jet surface; and a bias member biasing the cap toward the inclined position;

the cap surface being pressed against the jet surface so as to be at the parallel position when the mover is at the contact position of the cap, and an upper part of the cap surface starting to separate from the jet surface when the mover starts to move toward the retracted position of the cap.

35. The ink jet recorder of claim 34, wherein the suction port is positioned below the lowest jet port.

36. The ink jet recorder of claim 35, wherein the suction device sucks when the mover starts to move toward the retracted position.

37. The ink jet recorder of claim 32, wherein the cap includes a recessed elastic body.

38. The ink jet recorder of claim 32, wherein the ink jet head includes a plurality of heads for jetting ink in different colors, the recovery apparatus including a plurality of caps each associated with one of the heads.

* * * * *